US006507715B2

(12) United States Patent
Okada

(10) Patent No.: US 6,507,715 B2
(45) Date of Patent: Jan. 14, 2003

(54) IMAGE FORMING APPARATUS HAVING DEVELOPING SUPPORTERS

(75) Inventor: Hisao Okada, Ibaraki (JP)

(73) Assignee: Hitachi Koki Co., LTD., Tokyo (JP)

( * ) Notice: Subject to any disclaimer, the term of this patent is extended or adjusted under 35 U.S.C. 154(b) by 0 days.

(21) Appl. No.: 09/899,077

(22) Filed: Jul. 6, 2001

(65) Prior Publication Data

US 2002/0003967 A1 Jan. 10, 2002

(30) Foreign Application Priority Data

Jul. 7, 2000 (JP) ..... 2000-206664

(51) Int. Cl.[7] ..... G03G 15/06; G03G 15/09
(52) U.S. Cl. ..... 399/55; 399/269; 399/270
(58) Field of Search ..... 399/55, 269, 270

(56) References Cited

U.S. PATENT DOCUMENTS 5,300,987 A * 4/1994 Aoyama et al. ..... 399/269 X
5,911,098 A * 6/1999 Gyotoku et al. ..... 399/269 X

* cited by examiner

*Primary Examiner*—William J. Royer
(74) *Attorney, Agent, or Firm*—Sughrue Mion, PLLC

(57) ABSTRACT

An image forming apparatus includes a developing device including plural developer supporters provided opposite to a photoconductor, a development bias applying unit for applying a development bias voltage generated by superimposing an AC voltage on a DC voltage to each of the developer supporters, and a phase shifter for shifting a phase of the AC voltage in the development bias voltage in each of the developer supporters.

3 Claims, 3 Drawing Sheets

IMAGE FORMING APPARATUS HAVING DEVELOPING SUPPORTERS

BACKGROUND OF THE INVENTION

1. Description of the Related Art

The present invention relates to an image forming apparatus typified by a copier or a laser printer, and particularly to an image forming apparatus comprising developing means for supplying a developer to a photoconductor holding an electrostatic latent image using plural developer supporters and forming a toner image on the photoconductor.

2. Description of the Related Art

In an image forming apparatus, a photoconductor is charged and image exposure according to image data is performed and an electric charge distribution, namely an electrostatic latent image, corresponding to an image pattern is formed on the photoconductor. The electrostatic latent image appears as a visible toner image first by developing toner according to the electric charge distribution. Thereafter, the toner image is transferred to a record material such as paper and is fixed on the record material by thermal fixing.

Here, a development method is performed using a two-component developer in which toner, which is coloring particles, of a resin powder with a particle size of the order of 10 $\mu$m and a carrier, which is magnetic particles such as ferrite, magnetite or an iron powder with a particle size of 50 to 150 $\mu$m are mixed.

Also, in a developing device, a magnet is provided and a developer is carried in a development part, which is a gap, between the photoconductor and a developing roll by a developer supporter (hereinafter called "developing roll") whose external cylinder rotates. As the developer is carried in the development part, toner adheres on the photoconductor according to a surface electric charge distribution by an electric field determined by a relation between a development bias voltage applied to the developing roll and a surface potential distribution determined by the surface electric charge distribution of the photoconductor.

In this case, a method of using a development bias voltage in which an AC voltage is superimposed on a DC voltage, as a development bias voltage, is described in, for example, JP-B-63-25350 or JP-B-3-2304.

An effect of the development bias voltage using this AC voltage is that even when the DC voltage is low, the amount of toner supplied can be increased by superimposing AC in comparison with the case of only DC. As a result of this, the effect occurs largely in a case making use of in non-contact development in a method of making development without bringing the developer into contact with the photoconductor is performed.

However, a case using the AC voltage in the development bias voltage, when a frequency of the AC voltage is indicated by f and a peripheral speed of the photoconductor is indicated by vp, streaky unevenness in density perpendicular to a rotation direction of the photoconductor occurs at cycle intervals P of vp/f in a rotation direction of the photoconductor as shown in FIG. 2. This is because the AC voltage is superimposed on the DC voltage as a development bias voltage, so that a surface potential of the photoconductor and a development bias voltage of the developing roll change with time and toner is developed more on the photoconductor when the potential difference becomes large and toner is developed less when the potential difference becomes small. For this reason, in the case of using the AC voltage in the development bias voltage, it is constructed so that the streaky unevenness in density does not occur conspicuously by setting the frequency f to a value higher than a certain extent.

However, since the cycle interval of this streaky unevenness in density has been determined by a ratio of a peripheral speed of the photoconductor to a frequency of the AC bias voltage, it is found that the frequency needs to be increased in an image forming apparatus with a large peripheral speed of the photoconductor, namely a high printing speed. But, when the frequency of the AC voltage is too high, the toner cannot follow a change in direction of an electric field caused by the AC voltage and an applied effect of an AC bias is not taken. From this, it has been determined that a frequency of 10 kHz or lower, particularly a range from 1 kHz to 5 kHz is effective as a frequency of the AC voltage.

As a result of this, in an image forming apparatus with a high peripheral speed, an occurrence of the streaky unevenness in density cannot be controlled even when the action of the AC bias voltage is in the effective frequency range.

SUMMARY OF THE INVENTION

An object of the invention is to provide an image forming apparatus in which streaky unevenness in density does not occur in a direction perpendicular to a rotation direction of a photoconductor as described above when an AC voltage is used as a development bias voltage in a developing device equipped with plural developer supporters.

The object is achieved by an image forming apparatus comprising a photoconductor supported endlessly movably, latent image forming means for recording and forming an electrostatic latent image on the photoconductor, and developing means for supplying a developer to the photoconductor holding the electrostatic latent image and forming a toner image on the photoconductor, characterized in that the developing means includes plural developer supporters provided opposite to the photoconductor, development bias applying means for applying a development bias voltage generated by superimposing an AC voltage on a DC voltage to each of the developer supporters, and phase shifting means for shifting a phase of the AC voltage in the development bias voltage in each of the developer supporters.

DETAILED DESCRIPTION OF THE PREFERRED EMBODIMENTS

Figure 1:
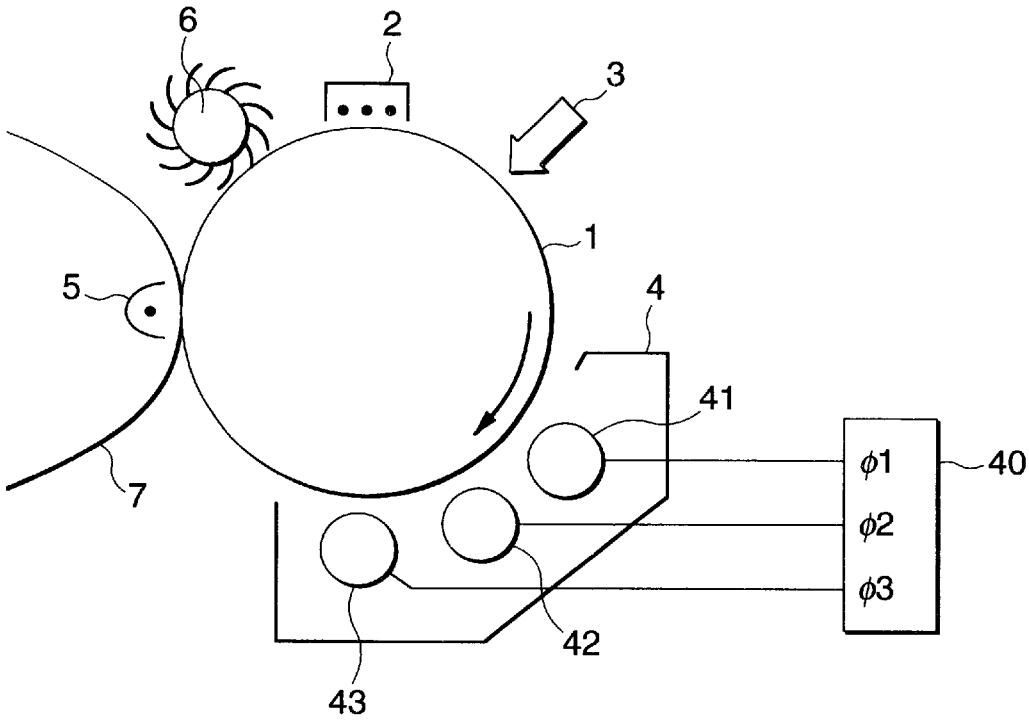
FIG. 1 is a schematic configuration diagram showing one embodiment of the invention.

An embodiment of the invention will be described below with reference to the accompanying drawings. First, an image formation process of an image forming apparatus will be described using FIG. 1. In FIG. 1, the surface of a photoconductor 1 which rotates in a clockwise direction is uniformly charged by a charger 2 and in an exposure device 3, light blinks according to image data and on the photoconductor 1, a portion to which light is emitted becomes conductive and electric charges on the surface disappear. As a result of this, an electrostatic latent image is formed on the photoconductor 1.

A developing device 4 is provided with two or more developing rolls 41, 42, 43 (three rolls in the embodiment) acting as developer supporters, and development bias voltages from a development bias power source 40 are applied to the respective developing rolls 41, 42, 43. Toner adheres to a place in which the electric charges on the surface of the photoconductor 1 disappear by action of an electric field between the photoconductor and the developing rolls 41, 42, 43. A toner image formed on the photoconductor 1 by the development is transferred on paper 7 by a transfer device 5. The toner image transferred on the paper 7 is melted by heating of a fixing device and is fixed on the paper 7 (not shown). Thereafter, the toner remaining on the photoconductor 1 is removed by a cleaner 6 and subsequently in like manner, images are formed.

In the embodiment, the bias voltages on which AC voltages are superimposed separately respectively from the development bias power source 40 are applied to the developing rolls 41, 42, 43 of the developing device 4. Phases $\phi 1$, $\phi 2$, $\phi 3$ of the AC voltages are adjusted by a phase shifter so as to become states of respectively different phases when the surface of the photoconductor 1 faces the respective developing rolls 41, 42, 43.

For example, in the case of the three developing rolls 41, 42, 43 as shown in this embodiment, if a phase of the AC voltage applied when the surface of the photoconductor 1 faces the developing roll 41 is used as a basis, it is adjusted so as to become a state in which a phase of 1/3 (120°) of one cycle is shifted when the surface of the photoconductor 1 faces the developing roll 42 and become a state in which a phase of 2/3 (240°) of one cycle is shifted when the surface of the photoconductor 1 faces the developing roll 43.

Figure 2:
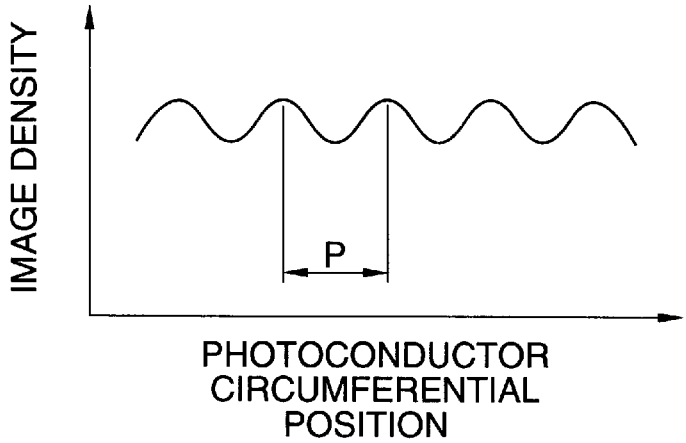
FIG. 2 is an illustration of unevenness in image density due to an AC bias.

At this time, in action of a development bias from the first developing roll 41, unevenness occurs in the amount of toner developed on the photoconductor 1 in a cycle P shown in FIG. 2. However, the phases of the AC voltages applied to the surface of the photoconductor 1 by the second and third developing rolls 42, 43 are shifted by 1/3 and 2/3, so that in the second and third developing rolls 42, 43, the phases become shifted by 1/3 and 2/3 from the unevenness occurring by the first developing roll 41. On the photoconductor 1, the toner developed by the first, second and third developing rolls 41, 42, 43 is sequentially superimposed, so that the unevenness is sequentially reduced.

When the description is made by unevenness in density of FIG. 2, it is found that the absolute value of the unevenness in density decreases by adding a waveform of the unevenness in density of the cycle P to a waveform shifted by 1/3, 2/3 cycle. Thus, in any places of the surface of the photoconductor 1, action of an AC bias becomes the same level averagely and the amount of toner developed becomes the same and the streaky unevenness in image density as described above does not occur.

Next, a method of shifting a phase of an AC voltage applied to a photoconductor from developing rolls will be described.

[First embodiment of shifting a phase]

As a first method, a method of simultaneously applying one development bias voltage to two developing rolls 41, 42 and adjusting a frequency of an AC voltage and shifting a phase of the AC voltage applied to the photoconductor 1 from the developing rolls 41, 42 will be described.

Figure 3:
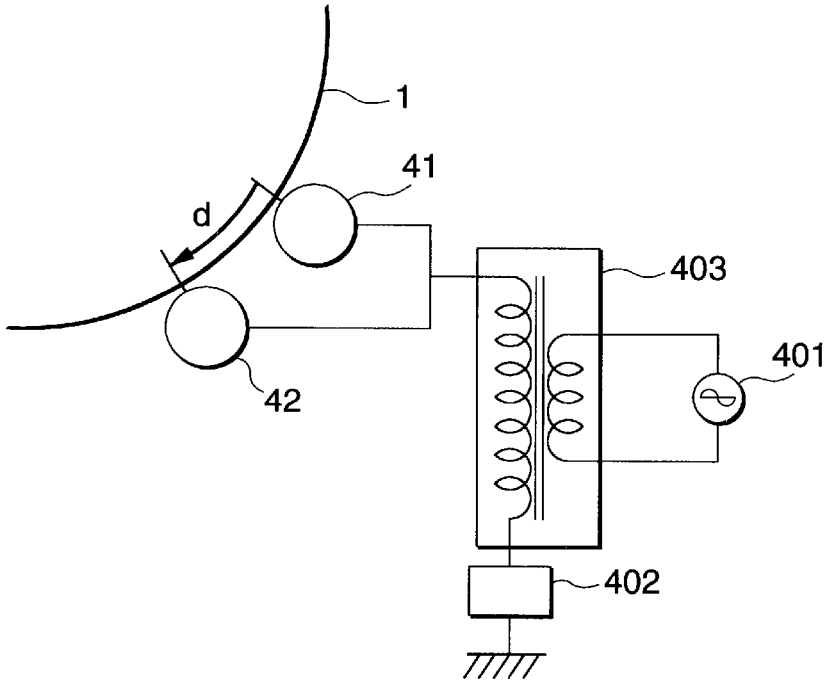
FIG. 3 is a schematic configuration diagram showing a first embodiment of a method of applying a development bias of the invention.

As shown in FIG. 3, it is assumed that an arrangement distance on the photoconductor 1 between the two developing rolls 41, 42 is d. Also, numeral 402 is a DC power source, and numeral 401 is an AC power source with a frequency f, and numeral 403 is a transformer (i.e., a phase shifter) which increases an AC voltage of the AC power source 401 up to a voltage available for a development bias. Since the DC bias power source 402 is connected in series with the transformer 403, a development bias voltage in which an AC voltage is superimposed on a DC voltage is applied to the developing rolls 41 and 42.

When it is assumed that a peripheral speed of the photoconductor is vp, time taken for a surface of the photoconductor 1 to move from a position of the developing roll 41 to a position of the developing roll 42 is d/vp and during this, an AC voltage changes by the number of times of $f \times d \div vp$. Here, when a value of the number of times of this change is an integer, phases of AC voltages applied to the surface of the photoconductor 1 from the developing rolls 41 and 42 are identical. On the other hand, when the value of the number of times of this change is not an integer, the phases of the AC voltages applied to the surface of the photoconductor 1 from the developing rolls 41 and 42 are different. Particularly, when the value of the number of times of this change is a value of m+0.5 (where m is an integer), it is found that the phases of the AC voltages applied to the surface of the photoconductor 1 from the developing rolls 41 and 42 are reverse. That is, when a value of a decimal fraction of the value of $f \times d \div vp$ is close to 0.5, the phases of the AC voltages applied to the surface of the photoconductor 1 from the developing rolls 41 and 42 become reverse approximately.

By the way, the arrangement distance d between the developing rolls 41, 42 and the peripheral speed vp of the photoconductor 1 cannot easily be changed in construction. But, a frequency can easily be changed by an oscillation frequency of an AC signal source, so that the phases of the AC voltages applied to the photoconductor 1 from the developing rolls 41, 42 can be changed by adjusting the frequency.

As a concrete numerical value, in the case that d=100 mm and vp=1000 mm/s, when it is assumed that m=10, it becomes $f \times d \div vp = 100.5$ by selecting a frequency f of 1005 Hz. By setting this frequency, the phases of the development bias applied to the photoconductor 1 from the two developing rolls 41, 42 can be reversed approximately, so that the amount of toner developed becomes uniform in a circumferential direction of the photoconductor 1 and the streaky unevenness in image density as described above does not occur.

Incidentally, in this case, to select the frequency f so that a value of a decimal fraction of the value of $f \times d \div vp$ becomes 0.5 is most effective in principle, but the effective action can be obtained as long as there is a range from 0.4 to 0.6.

[Second embodiment of shifting a phase]

Figure 4:
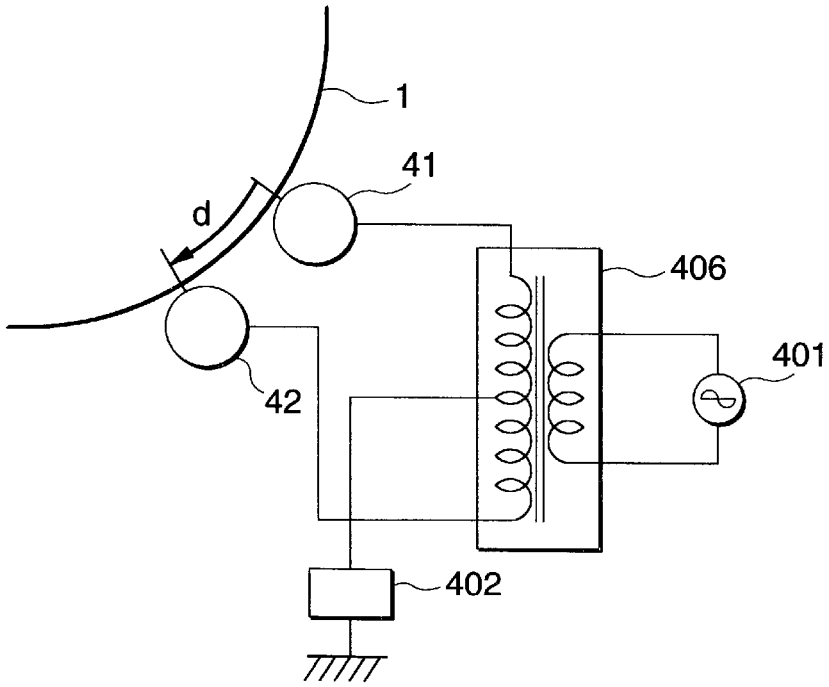
FIG. 4 is a schematic configuration diagram showing a second embodiment of a method of applying a development bias of the invention.
Figure 5:
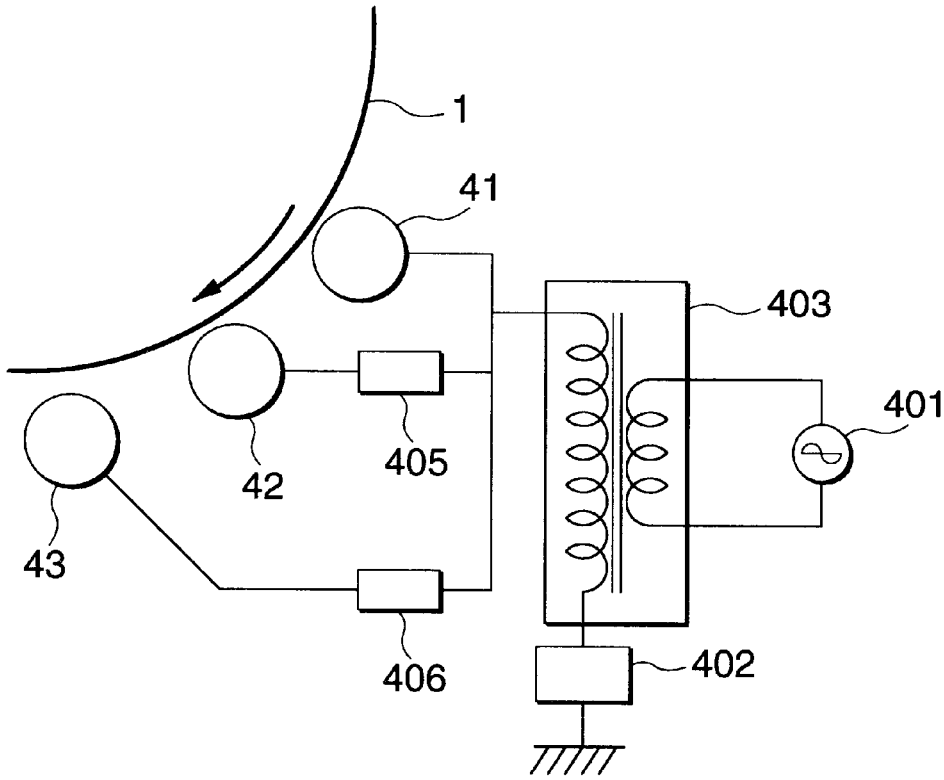
FIG. 5 is a schematic configuration diagram showing a third embodiment of a method of applying a development bias of the invention.

As a second method, a method of reversing a phase of an AC voltage applied to two developing rolls and adjusting a frequency of the AC voltage and shifting the phase of the AC voltage applied to a photoconductor from the developing rolls will be described. As shown in FIG. 4, a transformer 406 with a middle point tap is used in an AC voltage of an AC power source 401. A DC power source 402 is connected to the middle point tap of the transformer 406 and connections are individually made from both terminals of the transformer 406 to developing rolls 41 and 42. Thus, an AC voltage with an opposite phase is applied to the developing rolls 41 and 42.

Then, in the case of this embodiment, a frequency f is selected so that the number of times of a change in the AC voltage becomes an integer during movement of the photoconductor surface from a position of the developing roll 41 to a position of the developing roll 42 contrary to the previous embodiment. That is, the frequency f is selected so that a value of f×d÷vp becomes an integer. By selecting the frequency thus, when the surface of the photoconductor 1 moves from the position of the developing roll 41 to the position of the developing roll 42, the AC voltage changes just by phases of integer times, but the AC voltage with a phase opposite to that of the developing roll 41 is applied to the developing roll 42.

Therefore, also in this case, in a manner similar to the first method, the phases of the AC voltages applied to the surface of the photoconductor 1 from the developing rolls 41 and 42 are reverse, so that the amount of toner developed becomes uniform in a circumferential direction of the photoconductor 1 and the streaky unevenness in image density as described above does not occur.

Incidentally, also in this case, to select the frequency f so that the value of f×d÷vp becomes just an integer is most effective in principle, but the effective action can be obtained even when the value deviates by the order of 0.1 from the integer value in a manner similar to the first method.

[Third embodiment of shifting a phase]

As a third method, a method of shifting a phase of an AC voltage applied to a photoconductor 1 from developing rolls 41, 42, 43 using a circuit 405, 406 for causing a phase to transition will be described. In a manner similar to FIG. 3, a development bias in which an AC voltage is superimposed on a DC voltage is generated by a DC power source 402, an AC power source 401 and a transformer 403. When this development bias is applied to three developing rolls 41, 42 and 43, the bias is applied to the first developing roll 41 as it is, but phase transition circuits 405 and 406 of the AC voltage are halfway inserted into the second and third developing rolls.

This phase transition circuit 405, 406 is a circuit for shifting a phase of the AC voltage, and can be constructed of passive circuit elements such as a resistor R, a capacitor C or an inductor L. As a circuit configuration, there is a kind of a filter circuit which includes a low-pass type for passing a signal of a low frequency or a high-pass type for passing a signal of a high frequency. There are various circuit configurations, and for use in a circuit for applying this development bias in which the AC voltage is superimposed on the DC voltage, it is necessary to pass the DC voltage, so that a circuit in which DC is not broken by a capacitor is used. As a concrete circuit, there are a parallel circuit with a capacitor C and a resistor R, a parallel circuit with a capacitor C and an inductor L, and a parallel circuit with a resistor R and an inductor L.

The respective amounts of phase transition are determined by a difference between a phase of an AC voltage of a development bias at the time when the surface of the photoconductor 1 moves to positions of the second developing roll 42 and the third developing roll 43 and a phase of an AC voltage to be applied to the developing roll 42 and the developing roll 43 using a phase of an AC voltage applied to the surface of the photoconductor 1 from the first developing roll 41 as a reference. Here, for convenience in description, it is assumed that the phase of the AC voltage changes just by integer times when the surface of the photoconductor 1 moves from a position of the first developing roll 41 to a position of the second developing roll 42 and a position of the third developing roll 43 in a manner similar to the second method. Concretely, it may be selected so that an arrangement distance d between the developing rolls 41, 42, 43 is 100 mm and a peripheral speed vp of the photoconductor 1 is 1000 mm/s and a frequency f is 1000 Hz.

In the case of setting this, phases of the AC voltage of the development bias applied to the developing roll 42 and the developing roll 43 may be shifted by 1/3 cycle and 2/3 cycle with respect to the developing roll 41 and as a concrete numerical value, delay time may be set by about 0.33 msec and about 0.67 msec, respectively.

When a parallel circuit with a resistor R and a capacitor C is used as the phase transition circuit, a 1 kΩ variable resistor is used as a resistor and a 1 $\mu$F capacitor is used as a capacitor. The reason why the variable resistor is used is because a desired phase transition is not necessarily effected in a fixed resistor since a bias voltage is influenced by a resistance of a developer or an electrostatic capacity. In this case, since a time constant becomes a maximum of 1 msec, a variable range is one cycle or more the AC voltage, so that an adjustment of the one cycle or less can be made by an adjustment of a resistance value and the delay time can be adjusted.

Therefore, also in this case, in a manner similar to the first and second methods, the phases of the AC voltages applied to the surface of the photoconductor 1 from the three developing rolls 41, 42, 43 are shifted by 1/3, so that the amount of toner developed becomes uniform in a circumferential direction of the photoconductor 1 and the streaky unevenness in image density as described above does not occur.

[Combination of the invention]

Next, in the case of three or more developing rolls, a method of applying the invention will be described. FIG. 1 is the case of three developing rolls and in this case, a phase-shifted development bias in which an AC voltage is superimposed on a DC voltage is applied to the three developing rolls, respectively. However, in the case of three developing rolls, the AC voltage is not necessarily superimposed in the development biases of all the developing rolls. The development bias in which the AC voltage is superimposed on the DC voltage may be applied to at least two developing rolls so that phases of the AC voltages applied to the surface of the photoconductor become reverse. For example, the AC voltage may be superimposed in the first and second development biases, and only the DC voltage may be used in the third development bias.

There are more combinations in the case of four developing rolls. In a first combination, a development bias in which an AC voltage with a different phase of an AC voltage applied to the surface of the photoconductor is superimposed is applied to all four developing rolls, respectively. In a second combination, the developing rolls are paired by two and in the respective pairs, an AC development bias in which phases of the AC voltages applied to the surface of the photoconductor become reverse is superimposed and applied. In this case, the development bias with the same frequency or the development bias with a different frequency may be applied to two pairs of the developing rolls. A third combination is applied to only the two developing rolls of the four developing rolls. There are six combinations for selecting the two developing rolls from the four developing rolls, and effective action can be obtained in any combinations.

[Verification of effectiveness of the invention]

A verification result that unevenness in density can be eliminated by applying the invention will be described. In a printer using a photoconductor with a peripheral speed of 250 mm/s and a developing device in which two developing rolls are placed at an interval of 40 mm, a development bias voltage with DC of 300 V and AC of 400 V (peak-to-peak value) was applied and a solid image was printed.

When a frequency is set to 100 Hz, streaky unevenness occurs in a cycle of 2.5 mm in the printed image density. When the frequency changes from 100 Hz to 110 Hz while doing printing continuously, there were places in which the unevenness in density does not occur at two spots of the printed image. In the range from 100 Hz to 110 Hz, there are 103 Hz and 109 Hz as the frequency for satisfying a condition of $(f \cdot d)/vp=m+0.5$ (where m is an integer). The places to which these frequencies are applied correspond to the two spots.

Conventionally, in the case of one developing roll, since the unevenness in density is conspicuous at a low frequency of the order of 100 Hz, it has been constructed so that the frequency is increased to 1 kHz or higher and a cycle of the unevenness in density is shortened and the unevenness in density is not conspicuous.

However, in the case of two or more developing rolls, by applying the invention, the unevenness in density can be eliminated even at a low frequency. Since this unevenness in density occurs at a ratio of the peripheral speed vp of the photoconductor to the frequency f as described already, in a printer with a high peripheral speed of the photoconductor (high printing speed), the unevenness in density becomes conspicuous even at a high frequency. On the other hand, when the frequency is too high, an applied effect of an AC bias is not taken. In such a high-speed printer, the invention enables a frequency at which the AC bias effectively acts to be used.

According to the invention, even in an image forming apparatus with a high peripheral speed of a photoconductor, a frequency at which an AC development bias effectively acts can be used without causing streaky unevenness in density on an image.

What is claimed is:

1. An image forming apparatus comprising:

a photoconductor supported endlessly movably, latent image forming means for recording and forming an electrostatic latent image on the photoconductor; and a developing device supplying a developer to the photoconductor holding the electrostatic latent image and forming a toner image on the photoconductor;

wherein said developing device includes plural developer supporters provided opposite to the photoconductor, a development power bias source for applying a development bias voltage generated by superimposing an AC voltage on a DC voltage to each of the developer supporters, and a phase shifter for shifting a phase of the AC voltage in the development bias voltage in each of the developer supporters.

2. An image forming apparatus as defined in claim 1, wherein when an arrangement distance between two adjacent developer supporters of the plural developer supporters in a movement direction of the photoconductor is indicated by d and a peripheral speed of the photoconductor is indicated by vp, a frequency f of the AC voltage substantially satisfies a condition of $(f \cdot d)/vp=m+0.5$ (where m is an integer).

3. An image forming apparatus as defined in claim 1, wherein when an arrangement distance between two adjacent developer supporters of the plural developer supporters in a movement direction of the photoconductor is indicated by d and a peripheral speed of the photoconductor is indicated by vp, a frequency f of the AC voltage substantially satisfies a condition of $(f \cdot d)/vp=m$ (where m is an integer) and AC voltages with opposite phases from each other are applied to the two adjacent developer supporters.

* * * * *